US006338540B1

(12) United States Patent
Hasegawa et al.

(10) Patent No.: US 6,338,540 B1
(45) Date of Patent: Jan. 15, 2002

(54) INK-JET PRINTING METHOD AND APPARATUS THEREFOR, AND PRINTING SYSTEM INCLUDING SAID APPARATUS

(75) Inventors: Masahide Hasegawa, Tokyo; Akira Katayama, Yokohama; Kouhei Ishikawa, Kawasaki; Shinichi Saijo, Yokohama; Kenichi Moritoki, Higashiyamato; Moriyoshi Inaba, Tokyo, all of (JP)

(73) Assignee: Canon Aptex Kabushiki Kaisha, Ibaraki (JP)

( * ) Notice: Subject to any disclaimer, the term of this patent is extended or adjusted under 35 U.S.C. 154(b) by 0 days.

(21) Appl. No.: 09/078,557

(22) Filed: May 14, 1998

(30) Foreign Application Priority Data

May 20, 1997 (JP) ..... 9-130046

(51) Int. Cl.[7] ..... B41J 2/165
(52) U.S. Cl. ..... 347/23
(58) Field of Search ..... 347/23, 19, 14, 347/30, 11, 12, 16, 9, 29, 35, 47

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,332 A | * | 12/1985 | Takahashi | 347/23 |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,341,163 A | * | 8/1994 | Hanabusa | 347/23 |
| 5,410,639 A | | 4/1995 | Gruel | |
| 5,617,122 A | | 4/1997 | Numata et al. | |

FOREIGN PATENT DOCUMENTS

| | | |
|---|---|---|
| EP | 0 398 347 | 11/1990 |
| EP | 0 443 808 | 8/1991 |
| FR | 2 710 171 | 3/1995 |
| JP | 54-056847 | 5/1979 |
| JP | 59-123670 | 7/1984 |
| JP | 59-138461 | 8/1984 |
| JP | 60-071260 | 4/1985 |
| JP | 63-132058 | 6/1988 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

An ink-jet printing apparatus receives image data from a host computer and prints the image data. If an elapsed time from an end of printing processing for one printing job to start of printing processing for the next job is less than a predetermined time period, printing processing for the next job is started, without subjecting ink-jet heads to a recovery process, following the end of printing processing for the one job. The recovery process is carried out not only when the predetermined period elapses but also whenever processing for printing on a predetermined amount of printing medium is executed.

35 Claims, 16 Drawing Sheets

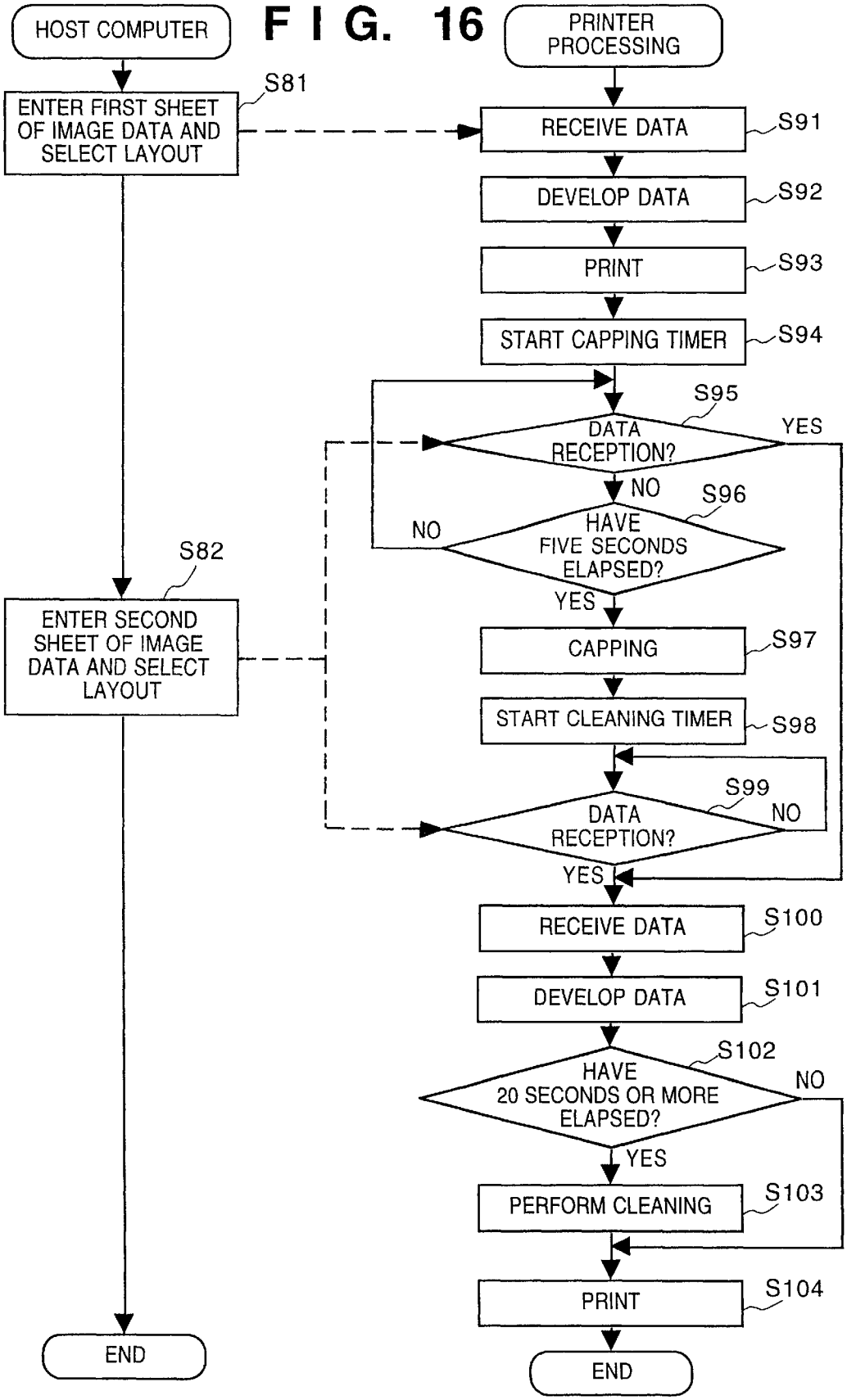
FIG. 16
HOST COMPUTER
PRINTER PROCESSING
ENTER FIRST SHEET OF IMAGE DATA AND SELECT LAYOUT
S81
RECEIVE DATA
S91
DEVELOP DATA
S92
PRINT
S93
START CAPPING TIMER
S94
S95
DATA RECEPTION?
YES
NO
S96
HAVE FIVE SECONDS ELAPSED?
NO
YES
S82
ENTER SECOND SHEET OF IMAGE DATA AND SELECT LAYOUT
CAPPING
S97
START CLEANING TIMER
S98
S99
DATA RECEPTION?
NO
YES
RECEIVE DATA
S100
DEVELOP DATA
S101
S102
HAVE 20 SECONDS OR MORE ELAPSED?
NO
YES
PERFORM CLEANING
S103
PRINT
S104
END
END

INK-JET PRINTING METHOD AND APPARATUS THEREFOR, AND PRINTING SYSTEM INCLUDING SAID APPARATUS

BACKGROUND OF THE INTENTION

This invention relates to an ink-jet printing method and apparatus for printing an image by jetting ink onto a printing medium from an ink-jet print head, as well as to a printing system which includes this apparatus.

An automatic vending machine that has recently become available is adapted to print an image on a medium such as a seal and sell the seal, wherein the image is a combination of, say, a photograph of the face of the customer and a digital image. By printing a color illustration and characters along with a photograph of one's face, such an automatic vending machine that sells these printed images provides the printed image with added value. Such printed images are utilized as name cards for personal use and there is growing demand for the capability to print the name of the customer on a color seal. It is desired that the printing apparatus used in such an automatic vending machine be capable of performing color printing for the purpose of raising the added value of the printed item and that the apparatus be capable of printing at high speed in order to meet the demands of a large number of customers.

An ink-jet printer, which has a color printing capability, is low in cost and provides a high-quality color image, has been contemplated for use as the printing apparatus in an automatic vending machine of the type mentioned above. However, such an ink-jet printer capable of printing a color image is provided with four ink-jet heads for the colors yellow, magenta, cyan and black, for example, and it is necessary to clean the ink-jet heads (perform a recovery process) before printing processing starts in order that images having stable image quality may be obtained at all times. In particular, when such a printer is employed in the above-described automatic vending machine, the times when the machine is used vary widely and it is necessary, therefore, that the head recovery process always be performed prior to the start of printing. Accordingly, whenever a single image is printed, the time needed to perform recovery process is greater than that for printing processing. This means that when processing for printing a plurality of images is executed, a very long period of time is required because the recovery process is executed each time an image is printed. This lengthens the time the customer must wait for images to be printed and causes a decline in the ability to service customers.

SUMMARY OF THE INVENTION

Accordingly, an object of the present invention is to provide an ink-jet printing method and apparatus, as well as a printing system that includes this apparatus, wherein the time needed for printing can be greatly curtailed by minimizing the number of times recovery process is performed for the ink-jet heads.

Another object of the present invention is to provide an ink-jet printing method and apparatus, as well as a printing system that includes this apparatus, wherein when a plurality of images are printed in succession, for example, recovery process is performed whenever a prescribed number of images is printed, thereby making it possible to greatly curtail total printing time needed for printing.

A further object of the present invention is to provide an ink-jet printing method and apparatus, as well as a printing system that includes this apparatus, wherein if the time required to accept succeeding image data following the completion of an image printing operation is greater than a predetermined period of time, recovery process for the ink-jet print head is executed at the start of the next printing operation, thereby reducing the number of times recovery process is performed and shortening the time needed for printing.

A further object of the present invention is to provide an ink-jet printing method and apparatus, as well as a printing system that includes this apparatus, wherein recovery process for the ink-jet print head is performed at the start of the next printing operation and transport of the printing medium is halted when the time required to accept succeeding image data following the completion of an image printing operation exceeds a predetermined period of time, or only when a predetermined number of sheets is printed, thereby making it possible to greatly curtail total printing time.

A further object of the present invention is to provide an ink-jet printing method and apparatus, as well as a printing system that includes this apparatus, wherein when printing processing does not start within a first predetermined period of time following the completion of an image printing operation, capping of the ink-jet head is carried out, and if elapsed time from the capping operation following the preceding printing operation is greater than a second predetermined period of time at the moment development of the next item of print data ends, recovery process for the ink-jet head is performed, thereby preventing a decline in printing quality as caused by drying of the ink-jet head and allowing total printing time to be shortened.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 16 is a flowchart illustrating an example of an operation performed by an automatic printed-matter vending machine according to this embodiment.

DESCRIPTION OF THE PREFERRED EMBODIMENTS

Preferred embodiments of the present invention will now be described in detail with reference to the accompanying drawings.

Figure 1:
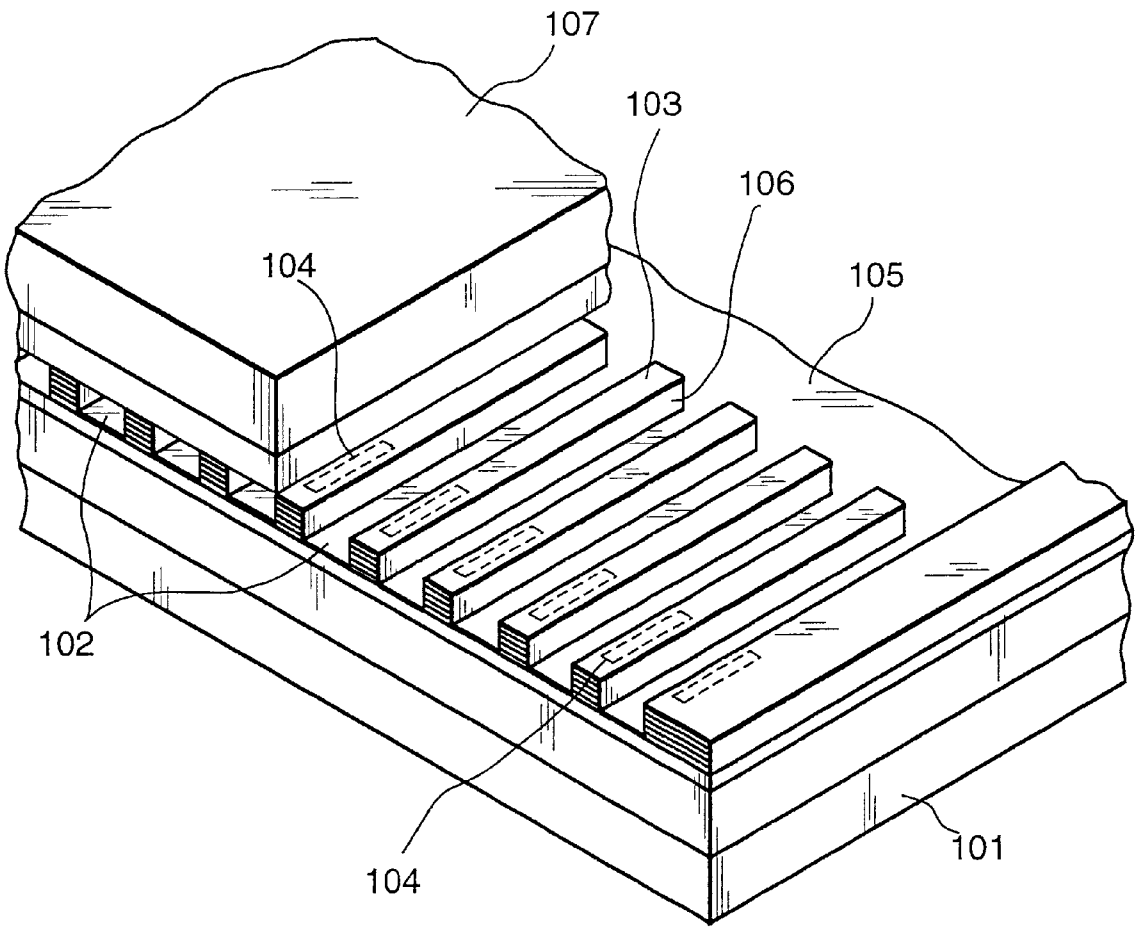
FIG. 1 is a perspective view showing the structure of an ink-jet head used in an ink-jet printing apparatus according to an embodiment of the present invention.

FIG. 1 is a perspective view showing the structure of an ink-jet print head used in an embodiment of the present invention.

The print head has a plurality of nozzles 106 each of which is provided with a corresponding heater 104. By applying prescribed electrical energy to the heaters 104 using a head driving circuit 705 (FIG. 3), described later, air bubbles are produced in the ink within the nozzles by the heat from the heaters 104, whereby ink droplets are discharged from orifices 102. The heaters 104 are formed on a silicon substrate 101 by a technique similar to that of a semiconductor manufacturing process. Nozzle partitions 103 construct the nozzles 106. A common ink chamber 105 supplies ink to each of the nozzles 106. A plate is shown at 107.

Figure 2:
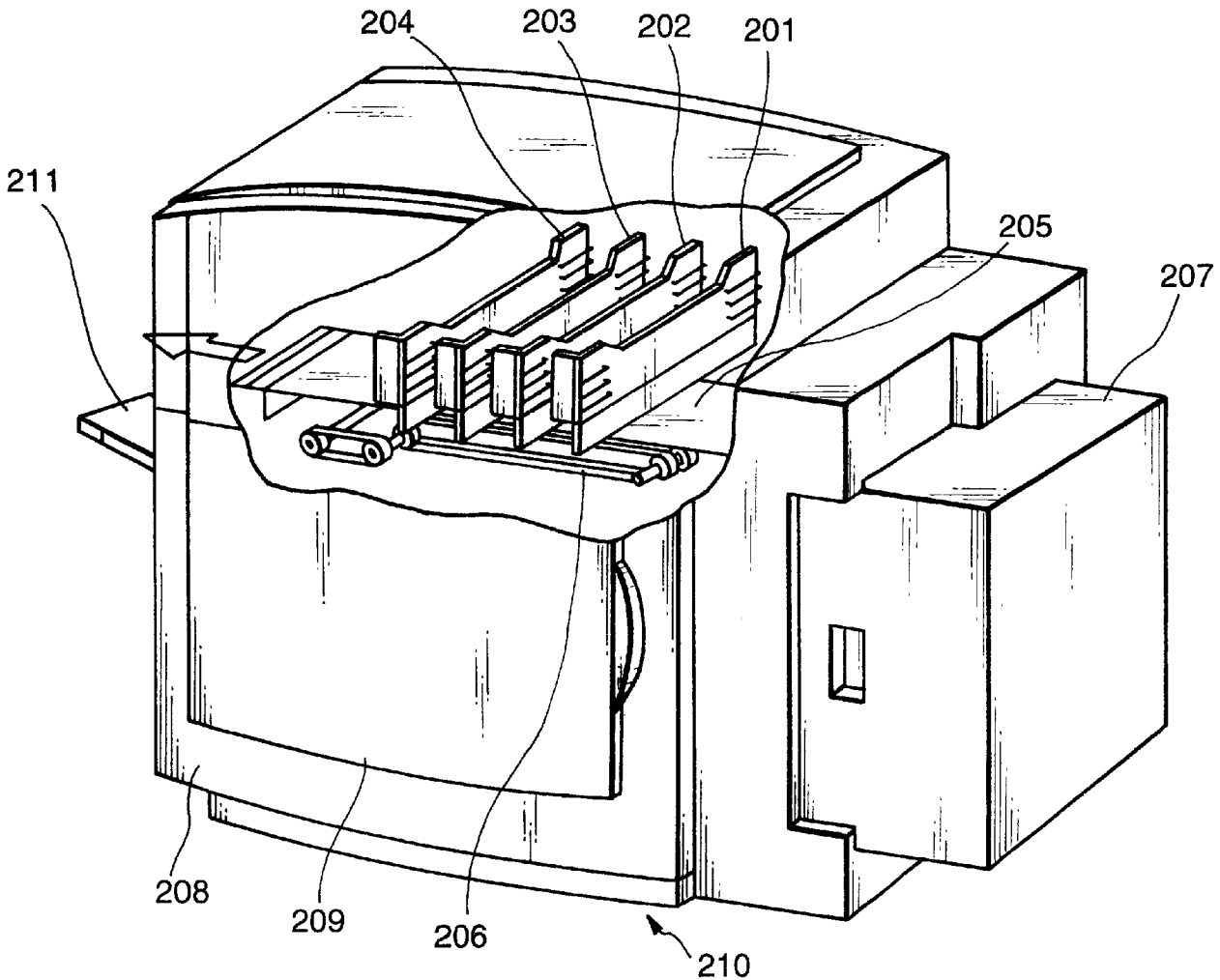
FIG. 2 is a see-through perspective view of the ink-jet printing apparatus according to the embodiment.

FIG. 2 is a see-through perspective view useful in describing the structure of an ink-jet printing apparatus 210 according to this embodiment.

The ink-jet printing apparatus 210 is equipped with ink-jet heads 201–204 and a recovery unit (a recovery mechanism shown in FIG. 3) which assures stable jetting of ink at all times. Printing paper 205 is supplied from a feed unit 207 to a printing position at which printing is performed by the ink-jet heads 201–204, and the printing paper is transported by a transport unit 206 provided on an ink-jet printer housing 208.

To print an image on the printing paper 205, black ink is jetted from the ink-jet print head 201 for the color black (K) when a reference position on the printing paper 205 arrives the ink-jet print head 201 during the transport of the paper. Similarly, inks of the respective colors are discharged, in the order mentioned, from the ink-jet print heads 202, 203 and 204 for the colors cyan, magenta and yellow, respectively, when the printing paper 205 arrives at the respective reference positions, whereby a color image is formed on the printing paper. The printing paper 205 on which the image has thus been printed is discharged into a stacker tray 211, on which sheets of the printing paper are stacked.

The ink-jet printing apparatus 210 of this embodiment includes, in addition to the transport unit 206, ink cartridges (not shown) for supplying inks to the ink-jet print heads 201–204, a pump unit (not shown) for supplying ink to the ink-jet print heads 201–204 and for performing a recovery operation, and a control substrate (not shown) for controlling the overall ink-jet printing apparatus 210. A front door 209 is opened and closed to replace the ink cartridges.

Figure 3:
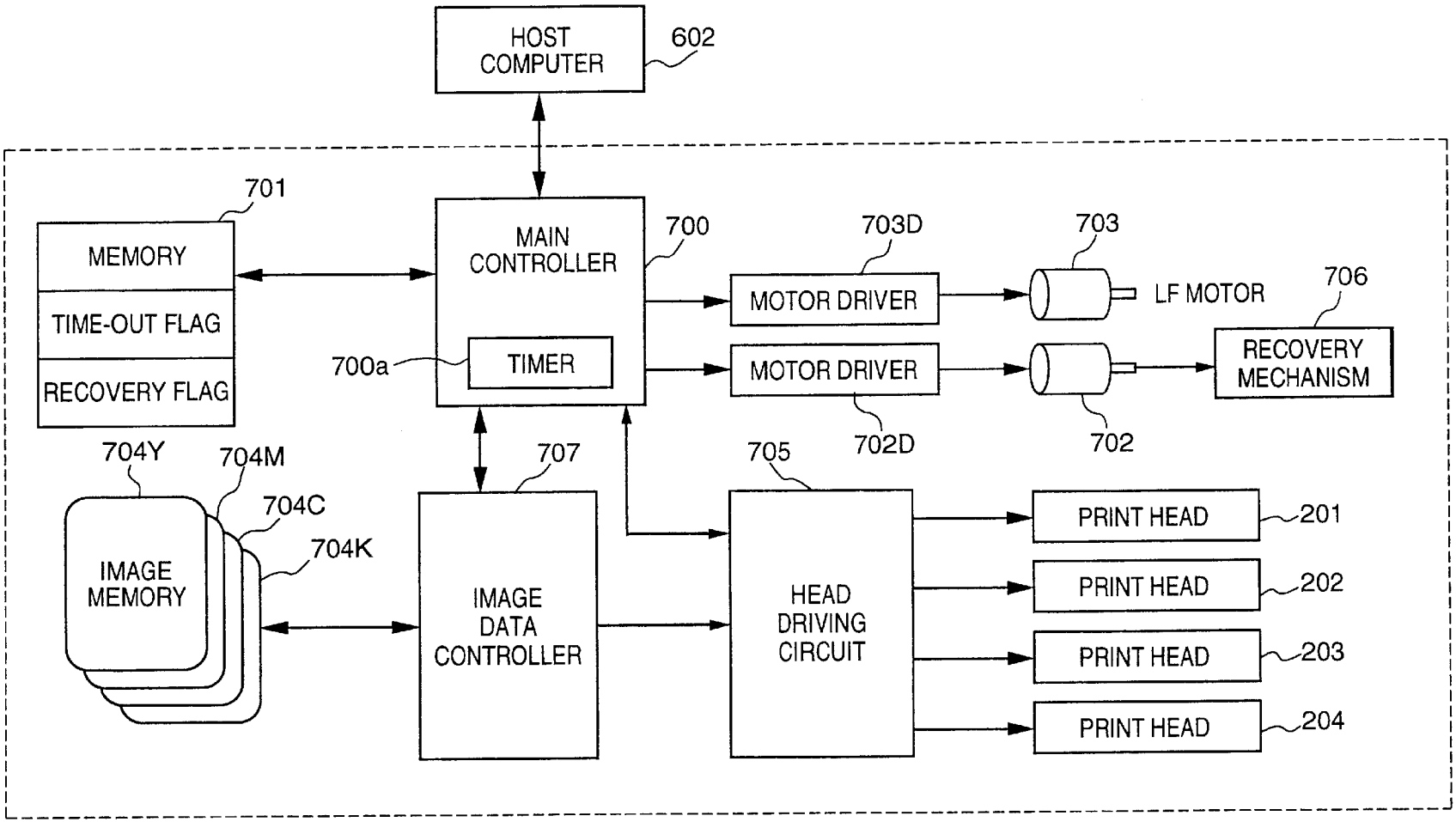
FIG. 3 is a block diagram showing the construction of the ink-jet printing apparatus according to the embodiment.

FIG. 3 is a block diagram showing the construction of the ink-jet printing apparatus 210 according to the embodiment.

In FIG. 3, the apparatus 210 includes a main controller 700 which, in accordance with a control program that has been stored in a memory 701, performs overall control of the ink-jet printing apparatus 210 of this embodiment. The main controller 700 has a timer 700*a* for measuring time that elapses between printing processing operations in a manner described later. The memory 701 has a ROM section and a RAM section, the latter of which is provided with a time-out flag and a recovery flag, etc., described later. A motor 702 moves the ink-jet print heads 201–204, via a clutch mechanism (not shown), between printing positions and recovery positions at which recovery is performed by a recovery mechanism 706, and drives the recovery mechanism 706 to subject the ink-jet print heads 201–204 to a recovery operation. A paper line-feed (LF) motor 703 transports sheets of printing paper. The motors 702, 703 are driven rotatively by corresponding motor drivers 702D, 703D, respectively, based upon commands from the main controller 700. Image memories 704Y–704K store image data of yellow, magenta, cyan and black components, respectively. The writing of image data to the image memories 704Y–704K and the reading of image data from the image memories 704Y–704K is executed under the control of an image data controller 707. A head driving circuit 705 causes printing to be performed by driving the corresponding ink-jet heads in dependence upon the image data of the respective colors based upon image data sent from the image data controller 707, this being performed in accordance with a command from the main controller 700.

As will be described later, a host computer 602 sends image data used in printing to the ink-jet printing apparatus 210 and instructs the apparatus to start printing processing. Further, as will be described in a later embodiment, the host computer 602 is capable sending the ink-jet printing apparatus 210 commands which indicate the number of sheets of printing paper to be printed on by the ink-jet printing apparatus 210 as well as a number of sheets that stipulates the time intervals at which a recovery process is to be executed (i.e., the recovery process is executed whenever the indicated number of sheets have been printed on).

As a result, using the functions of the image data controller 707, the ink-jet printing apparatus 210 develops the image data of the respective color components into bitmaps in the respective image memories 704Y–704K. When the image data of the four colors Y, M, C and K has been developed in the respective image memories 704Y–704K, the main controller 700 rotates the LF motor 703, which is for transporting the printing paper, thereby starting the transport of the printing paper. In synchronization with the transport of the printing paper, the image data controller 707 successively reads the image data of the corresponding colors out of the image memories 704Y–704K and outputs the image data to the ink-jet heads 201–204, which jet the inks of the corresponding colors, via the head driving circuit 705. Thus, the ink-jet heads 201–204 jet inks in accordance with the input image data, thereby printing a color image.

Figure 4:
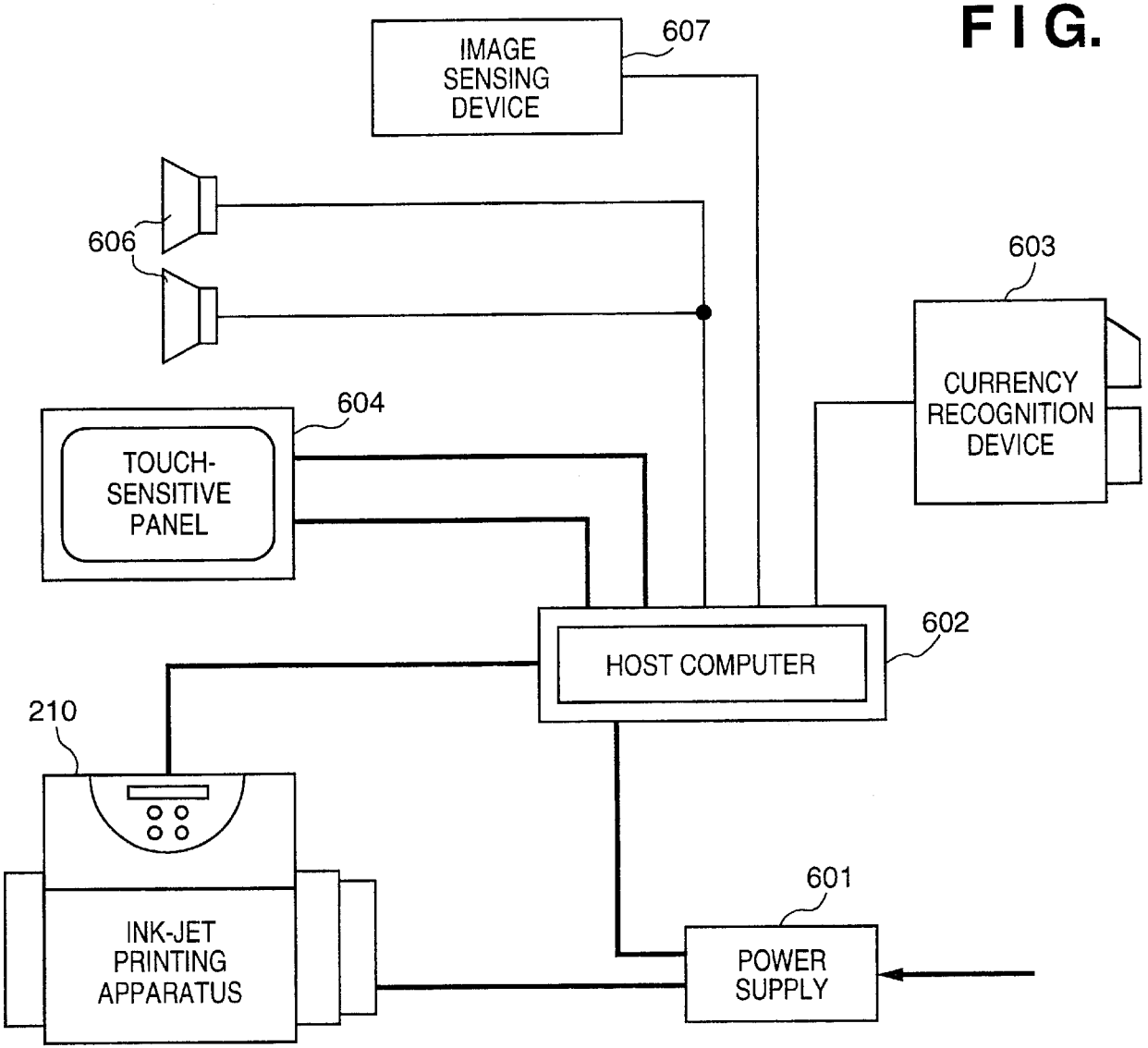
FIG. 4 is a block diagram showing the basic construction of an automatic printed-matter vending machine having the ink-jet printing apparatus according to the embodiment.

FIG. 4 is a block diagram showing the basic construction of an automatic printed-matter vending machine using the ink-jet printing apparatus 210 according to this embodiment.

In response to customer operation of a touch-sensitive panel 604 attached to a display device for displaying messages, print information such as the name of the customer and messages enter the host computer 602. At this time the host computer 602 displays a message on the display device having the touch-sensitive panel 604. Using the touch-sensitive panel 604, the customer selects a desired image illustration. The host computer 602 then digitally combines the entered name and message and the selected image illustration or video picked up by an image sensing device 607 and creates image data that is to be sent to the ink-jet printing apparatus 210. The image data thus created is sent to the ink-jet printing apparatus 210, which proceeds to print the image data. Upon sending the image data of the first print to the ink-jet printing apparatus 210, the host computer 602 allows the customer to select the next image illustration and, after executing processing similar to that for the first print, sends image data of a second print to the ink-jet printing apparatus 210. The host computer 602 repeatedly executes this processing a predetermined number of times. Depending on the model of the automatic vending machine, the number of prints of an image may be fixed or may be selectable at will.

An uninterrupted power supply 601 supplies the automatic vending machine of this embodiment with power in stable fashion. A currency recognition unit 603 recognizes currency that has been inserted and determines whether the prescribed amount of money has been introduced. Speakers 606 play background music during printing by the ink-jet printing apparatus 210 and produce voice messages to describe to the customer the operation that is to be performed.

The recovery process performed in the ink-jet printing apparatus 210 is a feature of this embodiment and will be described next.

[First Embodiment]

Figure 5A:
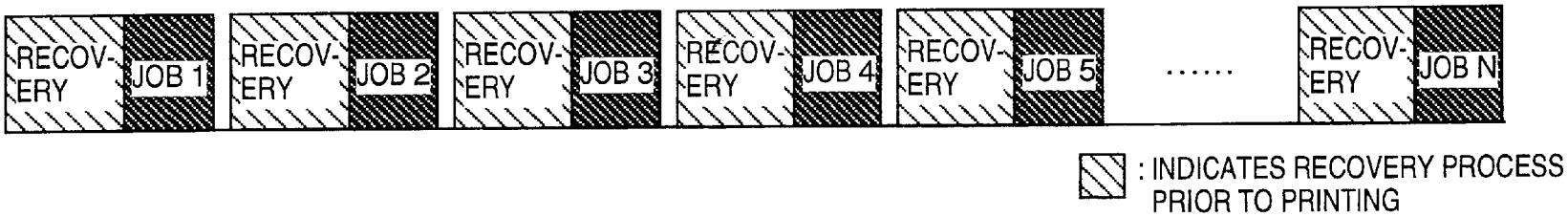
FIGS. 5A and 5B are diagrams illustrating a comparison between printing processing according to a first embodiment of the present invention and printing processing according to the prior art.

FIG. 5A illustrates a conventional recovery process control method when different printing processing operations (referred to as "jobs" below) are carried out in successive fashion. In this example, a recovery process is always performed before each job.

Figure 5B:
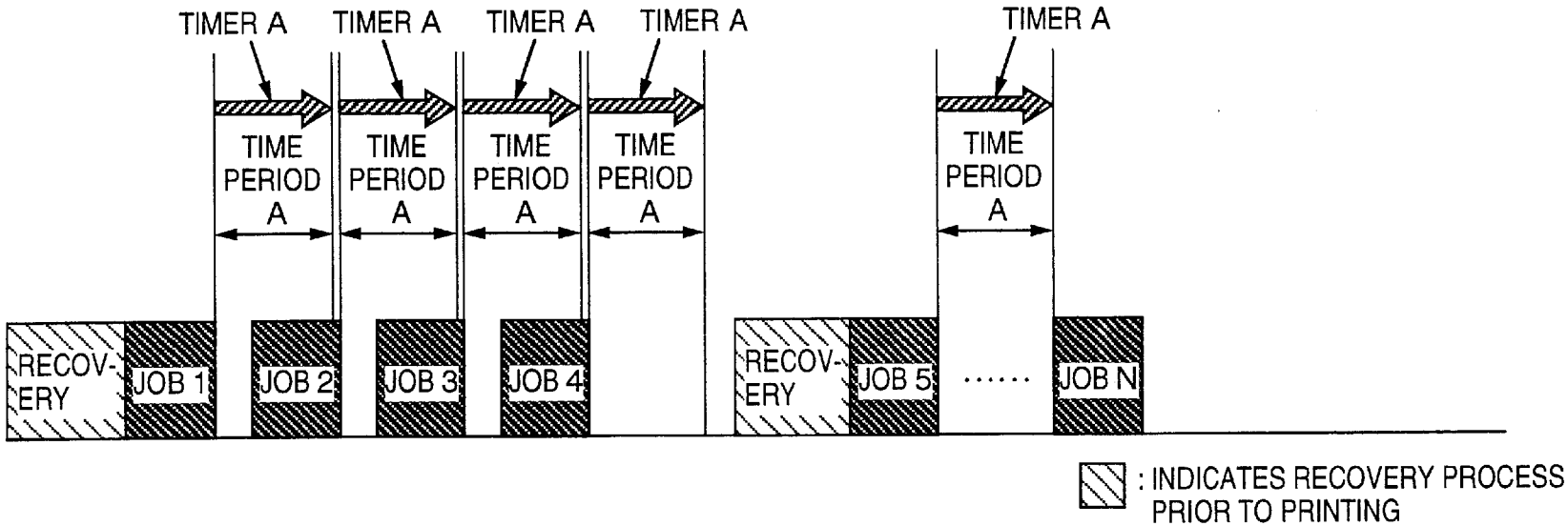

FIG. 5B is a diagram useful in describing a recovery process method when different jobs are carried out in successive fashion according to the first embodiment. FIG. 5B clearly shows that if, after the end of one job, the next job is started within a time period "A" measured by a timer A, the next job is started uninterruptedly without the execution of the recovery process. On the other hand, if the time until the start of the next job exceeds "A", then recovery process is executed immediately before the start of the next job just as in the case of FIG. 5A.

Figure 6:
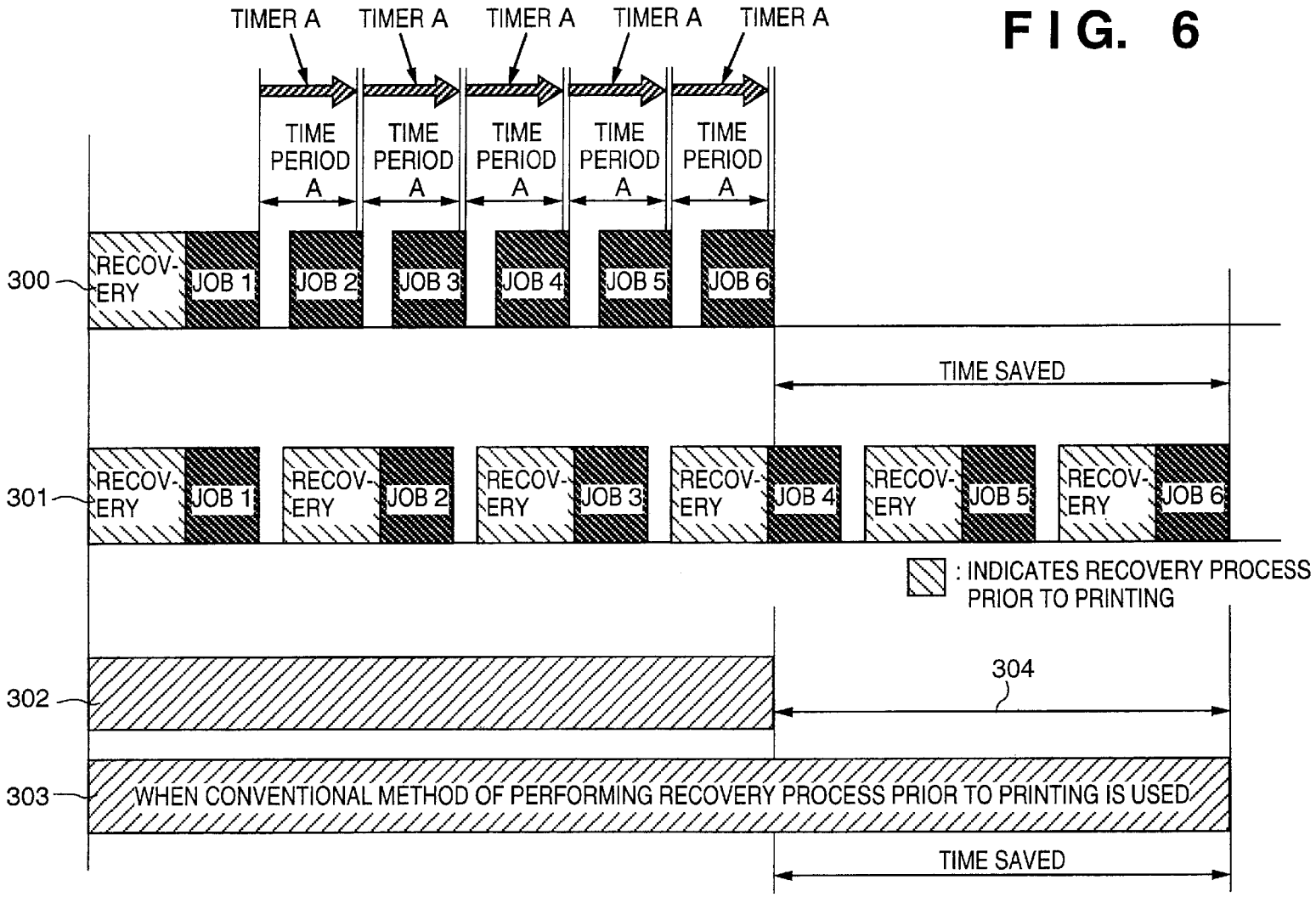
FIG. 6 is a diagram useful in describing a difference between the time required for printing processing according to the first embodiment of the present invention and the time required for printing processing according to the prior art.

FIG. 6 is a diagram showing an example of a comparison of processing times according to the prior art and according to the first embodiment when six jobs are performed in succession.

Printing processing according to the first embodiment is shown at 300 in FIG. 6, and printing processing according to the prior art is illustrated at 301. Total time required when six jobs are executed in succession according to the first embodiment is indicated at 302, and total time required when six jobs are executed in succession according to prior-art processing is indicated at 303. The portion indicated at 304 represents the time saved by the first embodiment.

Figure 7:
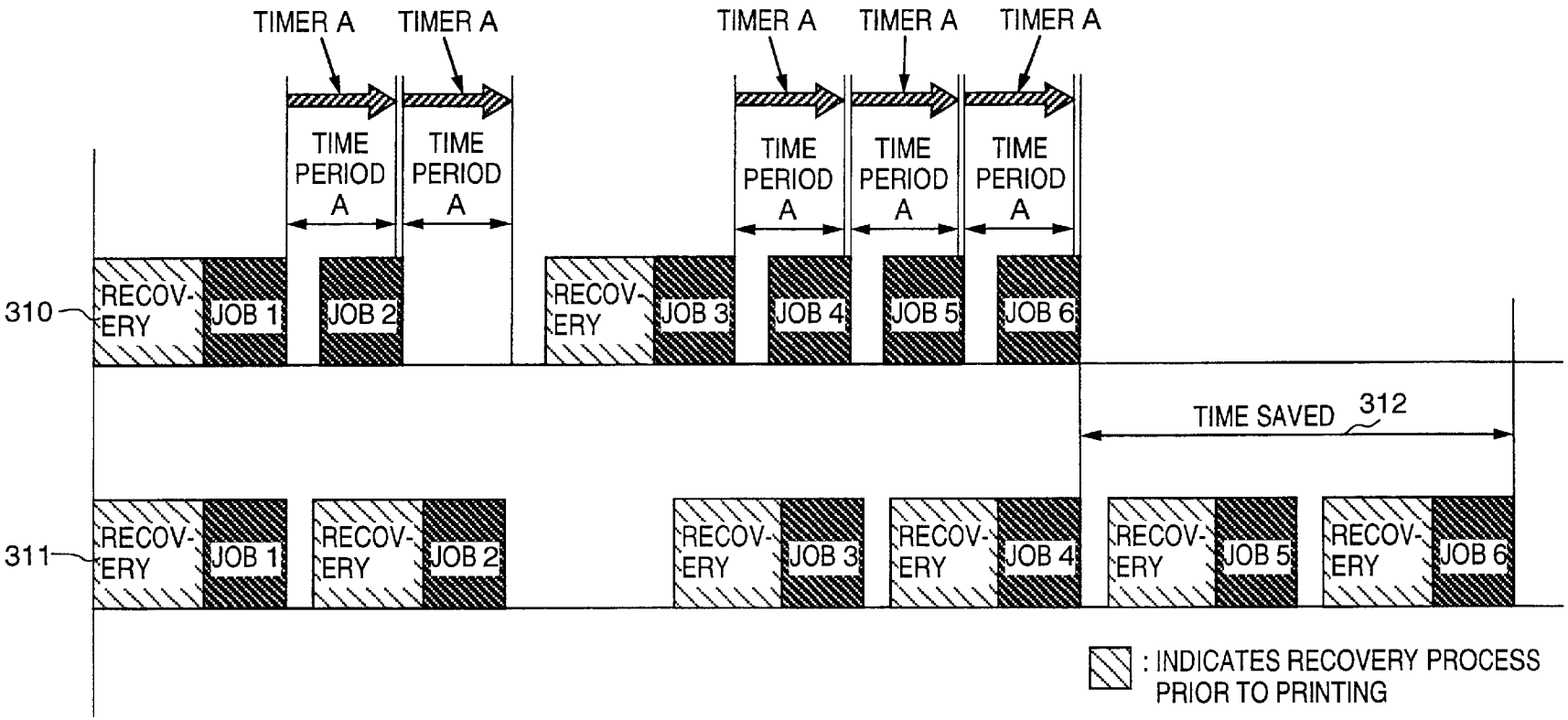
FIG. 7 is a diagram useful in describing the difference between another example of printing processing according to the first embodiment of the present invention and printing processing according to the prior art.

FIG. 7 illustrates a case in which a time interval (time in which no data is received from the host computer 602) greater than the time "A" between second and third jobs is vacant when six jobs are executed in succession in the same manner as in FIG. 6. Processing according to this embodiment is indicated at 310 in FIG. 7, and conventional printing processing is indicated at 311.

In this case, as in the case of FIG. 6, it will be understood that total printing time in the first embodiment is shorter than that in the prior art by a length of time indicated at 312.

Figure 8:
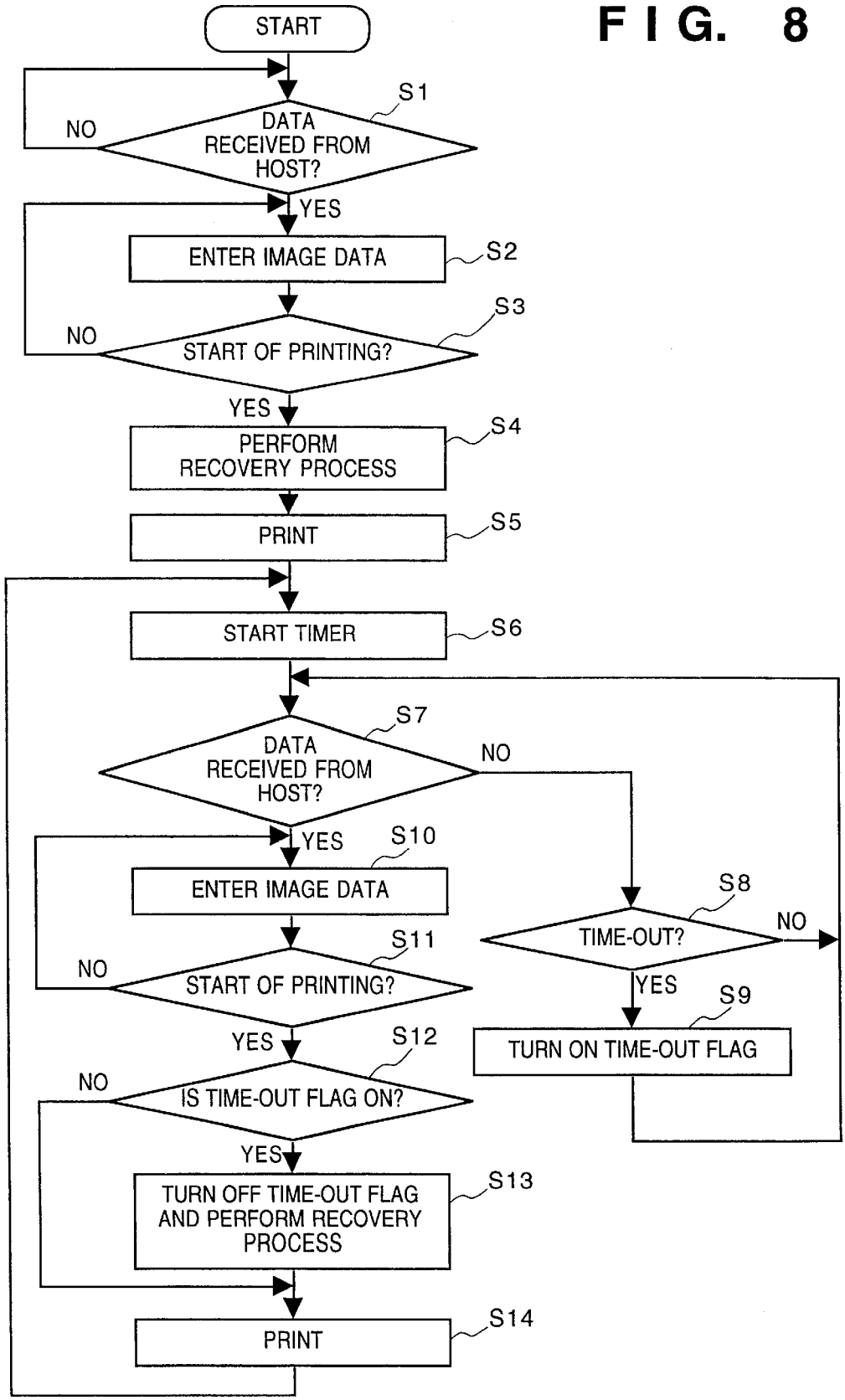
FIG. 8 is a flowchart illustrating printing processing in an ink-jet printing apparatus according to the first embodiment.

FIG. 8 is a flowchart illustrating printing processing in the ink-jet printing apparatus 210 according to the first embodiment. The control program for executing this processing is stored in a ROM area of the memory 701.

It is determined at step S1 whether image data has been sent from the host computer 602. If image data has been sent, then control proceeds to step S2, at which the image data is received and images are developed in each of the image memories 704Y–704K in conformity with the colors of the image data. This is followed by step S3, at which it is determined whether printing start timing has arrived in response to entry of a printing start command from the host computer 602. If printing start timing has not yet arrived, then control returns to step S2 so that image data may be received and stored. When the start of print timing is found to have been commanded at step S3, control proceeds to step S4. Here the ink-jet heads 201–204 are subjected to the recovery process the first time by the recovery mechanism 706. This is followed by step S5, at which the image data received and stored in the image memories 704Y–704K at step S2 is output to the ink-jet heads 201–204 and printing is carried out.

When printing is finished, control proceeds to step S6, at which the timer 700*a* is activated to start measuring time. Next, at step S7, it is determined whether image data has been received from the host computer 602. If image data has not been received, control proceeds to step S8, at which it is determined whether the timer 700*a* has timed out by measuring more time than the time "A". If the decision rendered is "NO", control returns to step S7. If the timer 700*a* has timed out, however, then control proceeds to step S9, at which the time-out flag in memory 701 is set to the ON state.

When it is found at step S7 that image data has been received from the host computer 602, the received image data is developed in the image memories 704Y–704K just as at step S2. When the start of printing processing is commanded at step S11, control proceeds to step S12, at which it is determined whether the time-out flag in memory 701 is ON. If the flag is found to be ON, control proceeds to step S13. Here the time-out flag is turned OFF, the recovery mechanism 706 is driven into operation, the ink-jet heads 201–204 are subjected to the recovery process and control proceeds to step S14. If the time-out flag is found to be OFF at step S12, then control proceeds to step S14 where, in a manner similar to that at step S5, the image data stored in the image memories 704Y–704K is output to the ink-jet heads 201–204 and printing is carried out.

Thus, the first embodiment is such that when images are printed in successive fashion, the jobs can be executed consecutively without subjecting the ink-jet heads to the recovery process immediately before each and every job. As a result, total printing time can be much shortened in comparison with the prior art.

[Second Embodiment]

Figure 9A:
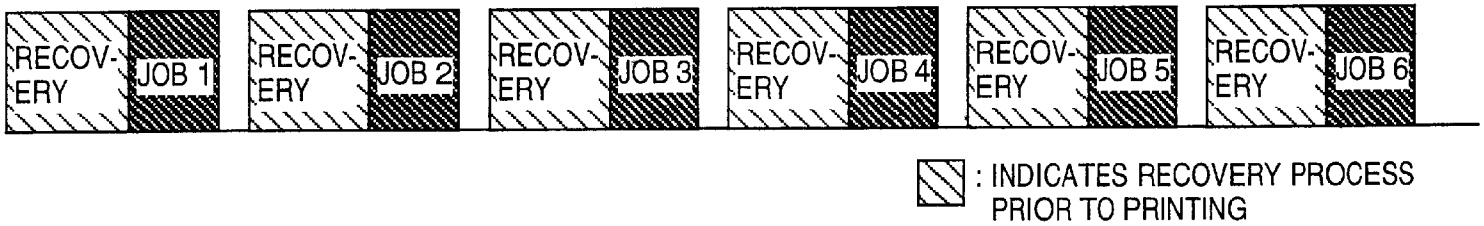
FIGS. 9A and 9B are diagrams illustrating a comparison between printing processing according to a second embodiment of the present invention and printing processing according to the prior art.
Figure 9B:
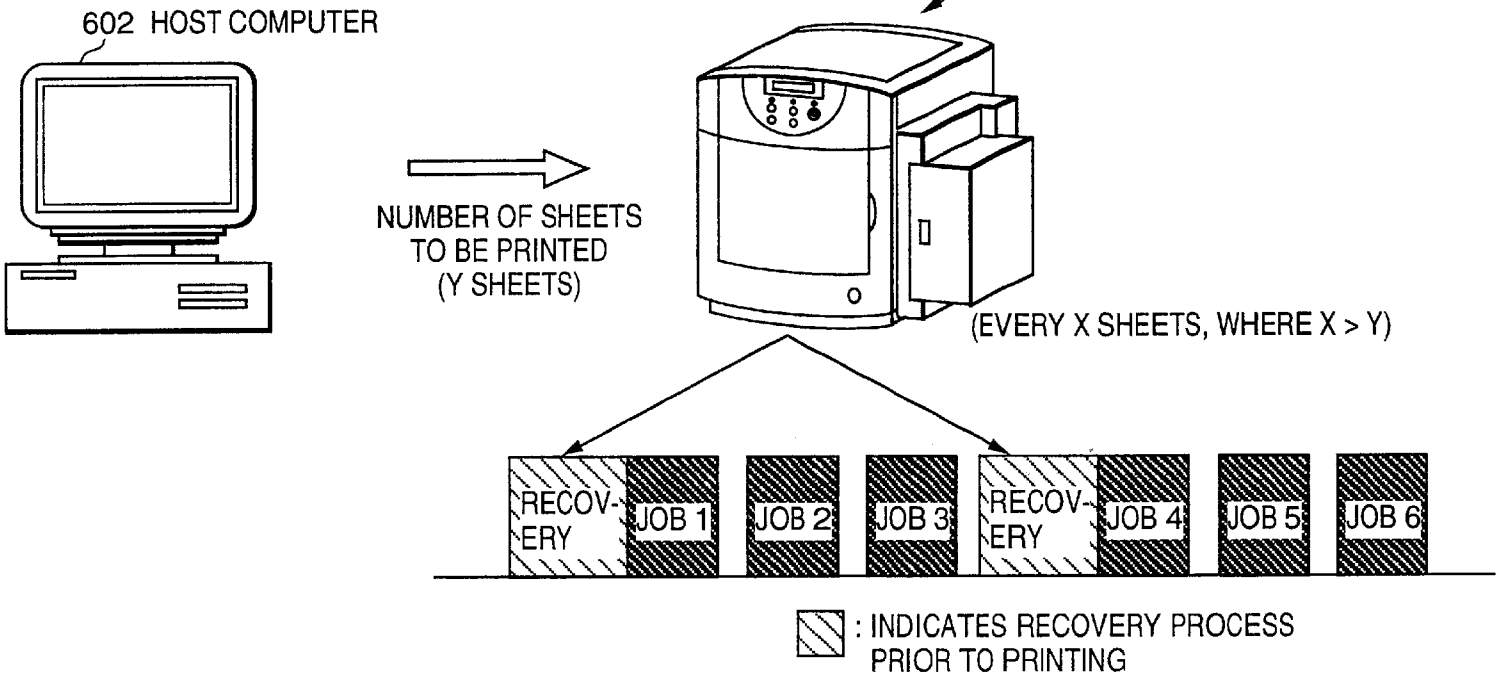

FIGS. 9A and 9B are diagrams for describing printing processing according to a second embodiment of the present invention, in which FIG. 9A is useful in describing a method of controlling the recovery process according to the prior art when six jobs are performed in succession and FIG. 9B is useful in describing a method of controlling the recovery process according to the second embodiment when six jobs are performed in succession.

In FIG. 9A, the ink-jet heads are subjected to the recovery process whenever each of the six successive jobs is started. By contrast, the second embodiment is so adapted that when a total of Y (=6) sheets are printed, the ink-jet heads are subjected to the recovery process every X (=3) (Y>X) images.

Figure 10:
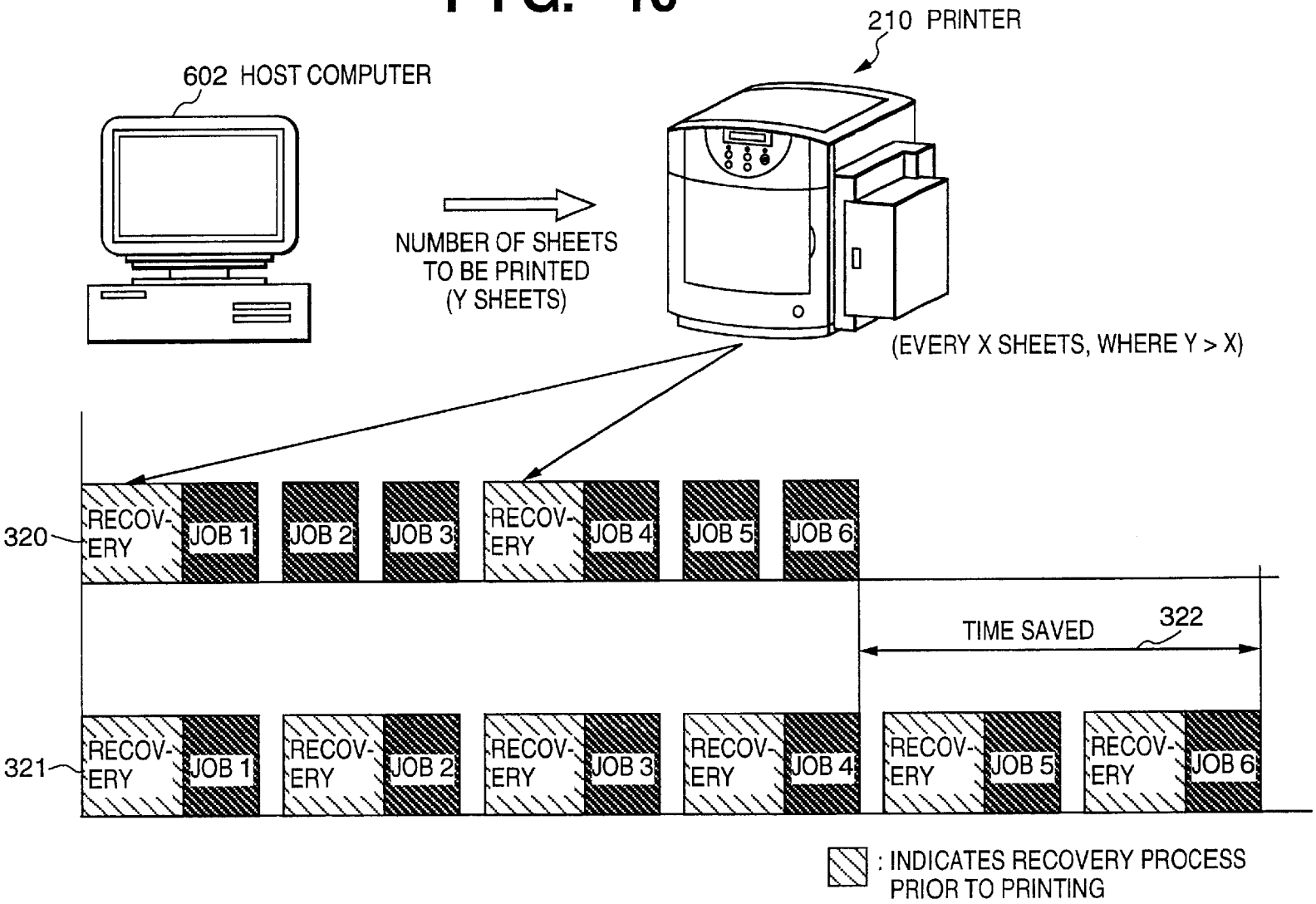
FIG. 10 is a diagram useful in describing a difference between the time required for printing processing according to a second embodiment of the present invention and the time required for printing processing according to the prior art.

FIG. 10 is a diagram useful in describing a difference between total printing time in connection with the recovery process according to the prior art and total printing time in connection with the recovery process according to the second embodiment.

Printing processing according to the second embodiment is shown at 320 in FIG. 10, and printing processing according to the prior art is illustrated at 321.

Thus, in accordance with the second embodiment, the total number (Y) of sheets to be printed is received from the host computer 602 and a recovery process prior to printing is executed every X sheets of the Y sheets. As a result, recovery timing prior to printing is controlled to shorten the total printing time necessary for printing all of the sheets.

Figure 11:
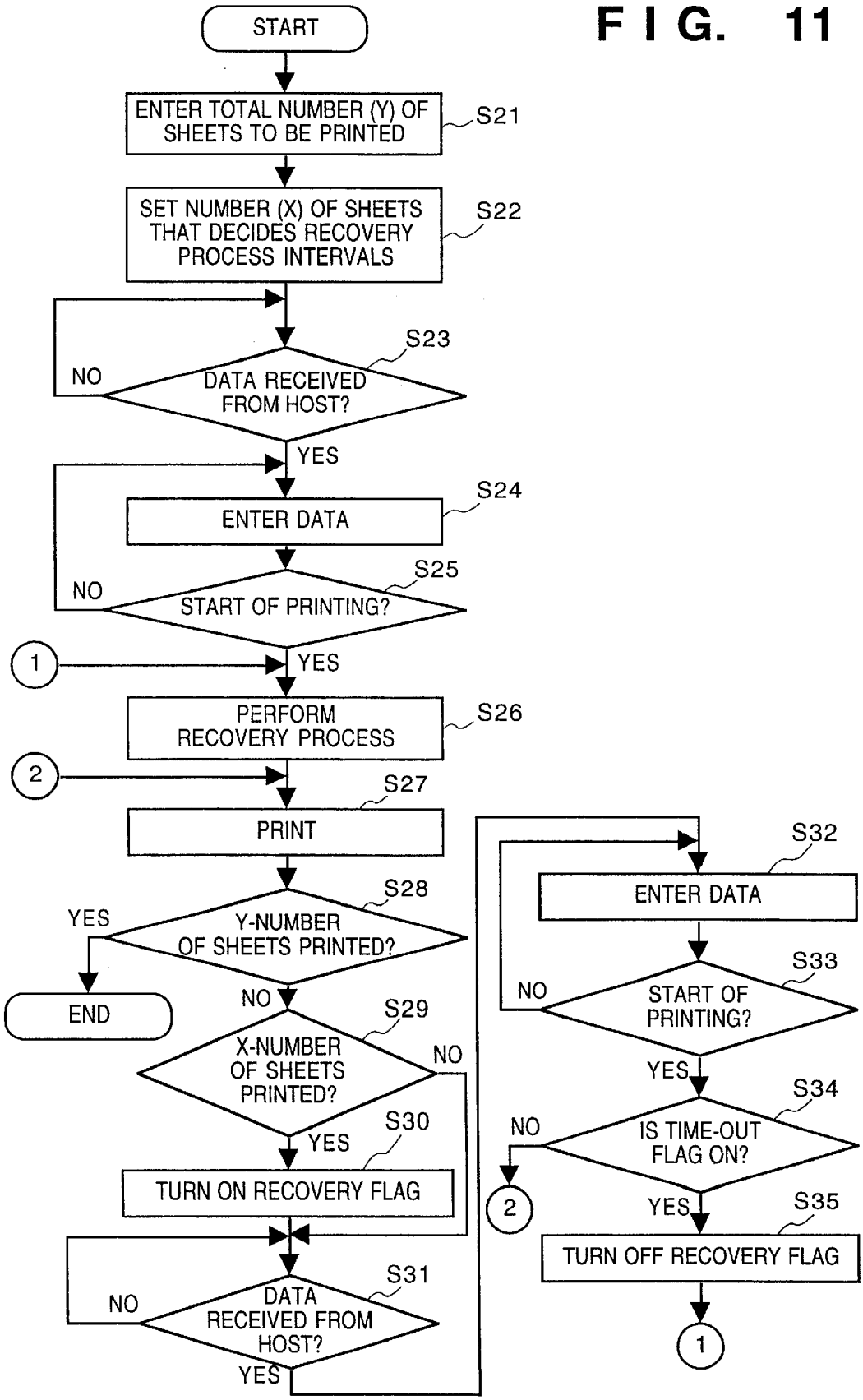
FIG. 11 is a flowchart illustrating printing processing in an ink-jet printing apparatus according to a second embodiment of the present invention.

FIG. 11 is a flowchart illustrating printing processing in the ink-jet printing apparatus 210 according to the second embodiment.

The total number (Y) of sheets to be printed is entered from the host computer 602 at step S21, after which the number (X, where Y>X holds) of sheets that stipulates the time intervals at which recovery process is to be performed is set at step S22. It should be noted that the number X of sheets that decides the recovery process intervals may be specified from the host computer 602 or from the control panel of the ink-jet printing apparatus 210.

Control then proceeds to step S23, at which it is determined whether image data has been received from the host computer 602. If image data has been received, then control proceeds to step S24, at which the received image data is stored in the image memories 704Y–704K according to color. This is followed by step S25, where it is determined whether the start of printing processing has been specified. If the answer is "YES", then control proceeds to step S26. Here the ink-jet heads 201–204 are subjected to the recovery process the first time by the recovery mechanism 706. This is followed by step S27, at which the image data received and stored in the image memories 704Y–704K at step S24 is output to the corresponding ink-jet heads 201–204 and printing is carried out.

When printing is finished, control proceeds to step S28, at which it is determined whether the number of sheets printed has attained the total number (Y) set at step S21. If the answer is "YES", processing is terminated. If the answer is "NO", on the other hand, then control proceeds to step S29, at which it is determined whether the number (X) of sheets, set at step S22, that decides the recovery process intervals has been attained. If X has not been attained, control proceeds to step S31. If X has been attained, then control proceeds to step S30, at which the recovery flag in memory 701 is turned on, after which control proceeds to step S31.

Processing similar to that of steps S23–S25 described above is executed at steps S31–S33. That is, image data is received from the host computer 602 and developed in the image memories 704Y–704K and, when that start of printing is discriminated at step S33, control proceeds to step S34, at which it is determined whether the recovery flag in memory 701 is ON. If the flag is found to be ON, control proceeds to step S35. Here the time-out flag is turned OFF, control proceeds to step S26 and the recovery process is executed immediately before the start of the next job. If the recovery flag is found to be OFF at step S34, then control proceeds to step S27. Here the next printing job is performed without the execution of the recovery process.

It goes without saying that when the same image data is printed on a plurality of sheets in succession, it is unnecessary to execute the steps S31–S33, which are for receiving image data from the host computer 602 from the second image onward.

As for the relationship between the total number of sheets printed and the number of sheets that decides the timing at which the recovery process is performed prior to printing, it is required that the timing for execution of the recovery process prior to printing be set within such limits that will not give rise to a nozzle that has not discharged ink during the execution of printing processing after ink has been initially discharged from all nozzles of the ink-jet heads.

Thus, as in the case of the first embodiment, the second embodiment also makes it possible to shorten total printing time when a plurality of sheets are printed. In addition, the second embodiment makes it possible to prevent the occurrence of any difficulties in terms of discharging ink from the ink-jet heads.

[Third Embodiment]

Figure 12:
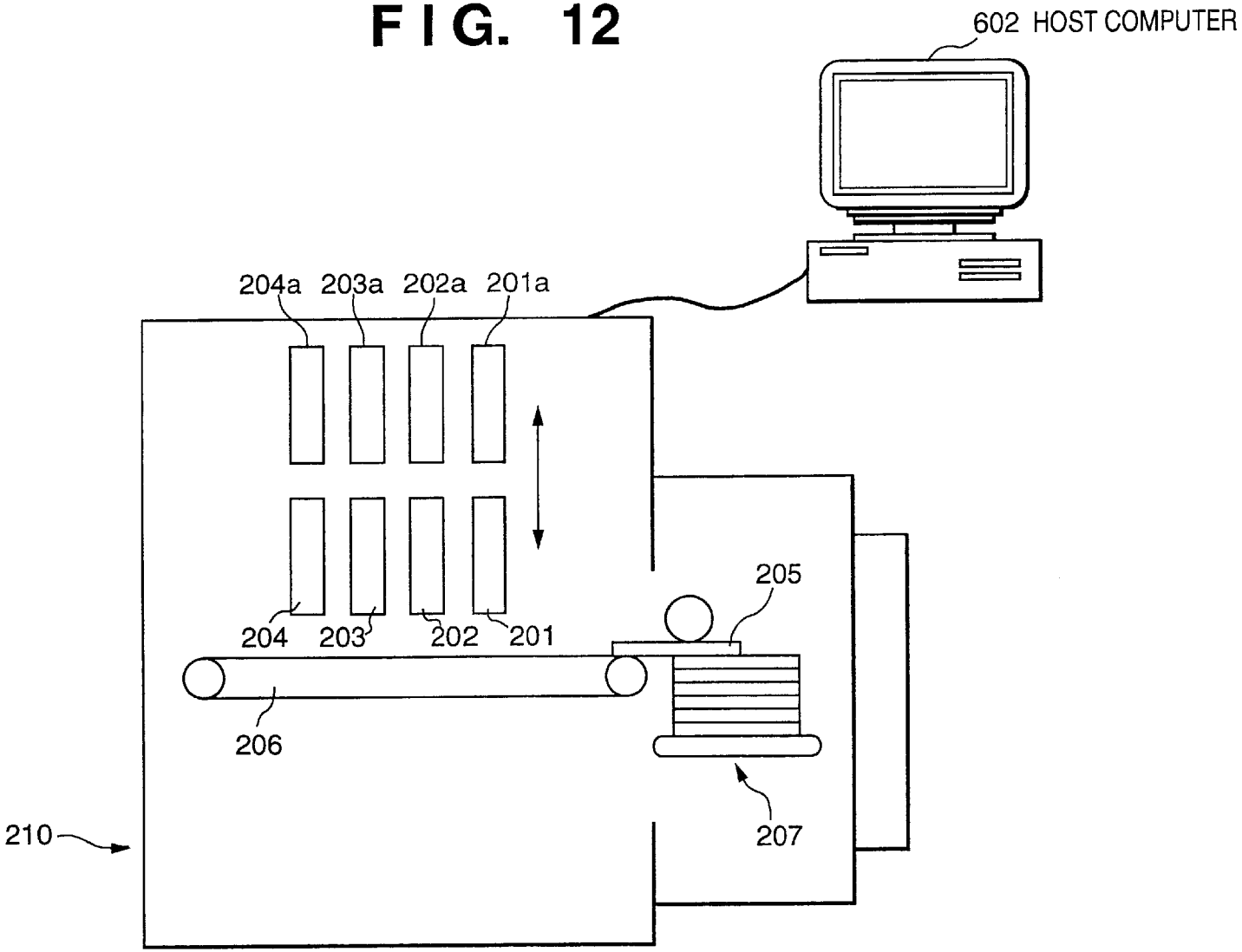
FIG. 12 is a schematic view showing the general construction of an ink-jet printing apparatus according to a third embodiment of the present invention.

FIG. 12 is a schematic view useful in describing the ink-jet printing apparatus 210 according to a third embodiment of the present invention.

The ink-jet printing apparatus 210 according to the third embodiment is constructed in such a manner that the ink-jet heads 201–204 can be moved between positions at which the ink-jet heads 201–204 can print on a printing medium and positions (201*a*–204*a*) for subjecting the ink-jet heads 201–204 to the recovery process.

According to the third embodiment, image data used in printing is sent from the host computer 602 to the ink-jet printing apparatus 210, where the image data is stored in the respective image memories 704Y–704K in conformity with the colors of the image data. When image data starts being received, the ink-jet printing apparatus 210 continues the reception of image data and the processing for developing images in the image memories 704Y–704K and, at the same time, if this is initial printing processing, moves the ink-jet heads 201–204 to the positions indicated at 201*a*–204*a* so that the recovery process may be performed by the recovery mechanism 706. The ink-jet heads 201–204 are then moved to the positions (indicated at 201–204) at which it is possible to print on the printing paper 205. The transport unit 206 for transporting the printing paper 205 is then driven into operation, in which state the apparatus waits for the end of processing for developing the image data in the image memories 704Y–704K of the ink-jet printing apparatus 210. When image data corresponding to one sheet of the printing paper 205 has finished being developed in the image memories 704Y–704K, the transport unit 206 and feeder unit 207 are driven into operation to feed only one sheet of the printing paper 205 and an image is formed on the printing paper 205 by ink droplets jetted from the ink-jet heads 201–204.

Thereafter, the ink-jet printing apparatus 210 waits for reception of the next image data and, when reception of the next image data starts, again waits for image data equivalent to one sheet of the printing paper 205 to be developed in the image memories 704Y–704K. When the development of this image data is finished, one sheet of the printing paper 205 is fed from the feeder unit 207 and an image is printed on the printing paper 205 by ink droplets jetted from the ink-jet heads 201–204. When reception of the next image data does not start within a predetermined period of time after the printing of one sheet of an image ends, drive of the transport unit 206 is halted and the ink-jet heads 201–204 are moved to the recovery process positions (201*a*–204*a*).

If processing for developing the next image data in the image memories 704Y–704K is not finished even upon elapse of a predetermined period of time from the moment the ink-jet heads 201–204 are moved to the positions at which printing can be performed on the printing paper 205, the ink-jet heads 201–204 are moved to the recovery process positions (201*a*–204*a*) in order to protect them. The processing for subjecting the ink-jet heads 201–204 to recovery process is executed immediately before the next job.

Figure 13:
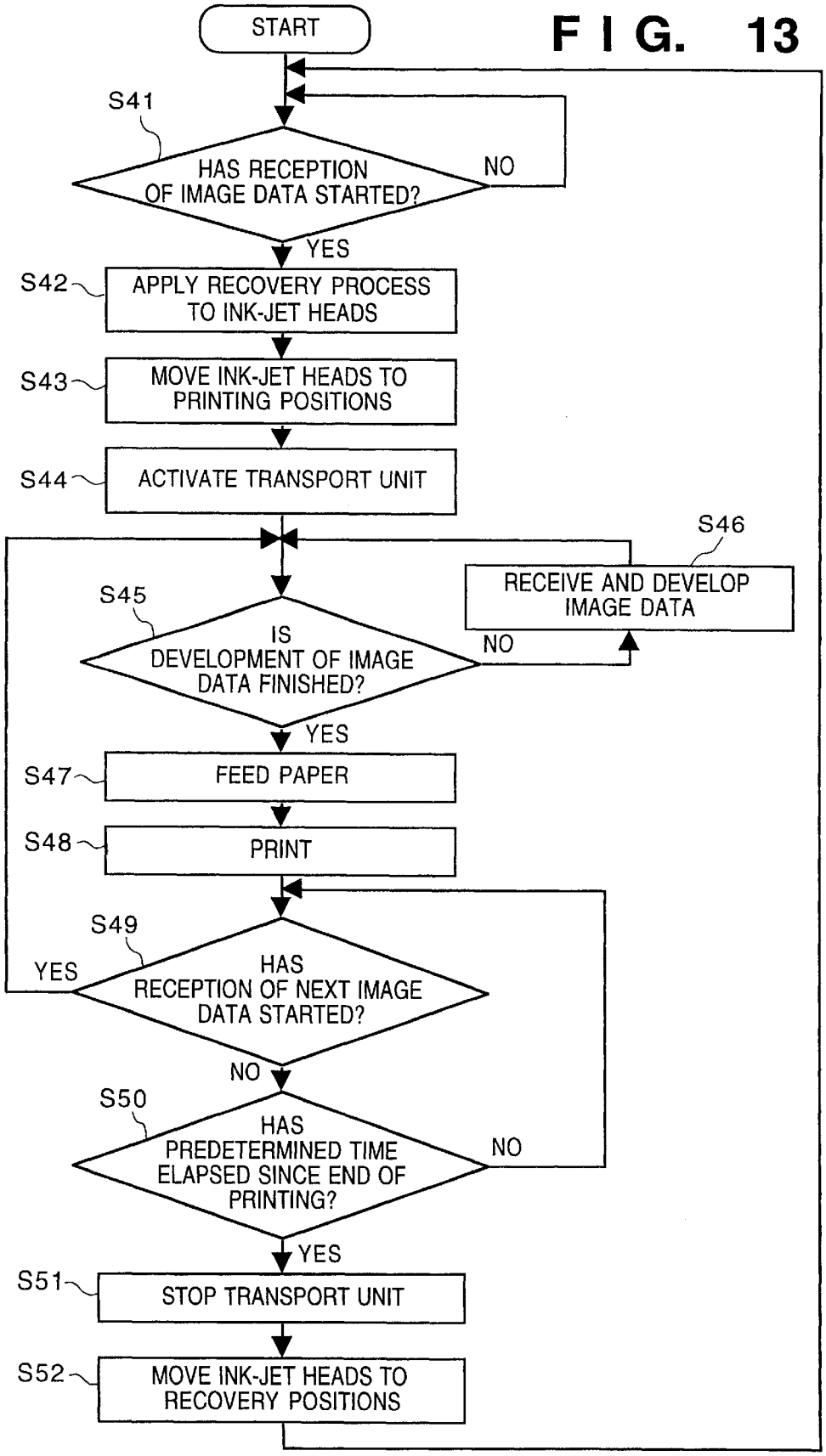
FIG. 13 is a flowchart illustrating printing processing in the ink-jet printing apparatus according to the third embodiment.

FIG. 13 is a flowchart illustrating printing processing in the ink-jet printing apparatus 210 according to the third embodiment.

When it is found at step S41 that reception of image data from the host computer 602 has started, control proceeds to step S42. Here the ink-jet heads 201–204 are moved to the recovery process positions and the recovery mechanism 706 is activated to perform the recovery process. Control then proceeds to step S43, at which the ink-jet heads 201–204 are moved to the print positions, and thence to step S44, at which activation of the transport unit 206 is started.

It is determined at step S45 whether the development of the image data in the image memories 704Y–704K has been concluded. If the answer is "NO", control proceeds to step S46 and the reception of image data from the host computer 602 and the processing for developing the image data in the image memories 704Y–704K are continued. When the processing for developing the image data in the image memories 704Y–704K has been concluded, control proceeds to step S47, at which one sheet of printing paper is fed from the feeder unit 207. Printing processing is then executed at step S48. When the printing of one sheet of image data is finished, control proceeds to step S49 and it is determined whether the next image data has been received. If the answer is "YES", control returns to step S45 to execute the processing for developing the image data in the image memories and the processing for printing the image data.

When it is found at step S49 that reception of the next data has not started, control proceeds to step S50. Here the timer 700*a* determines whether a predetermined period of time has elapsed since the end of the preceding image printing operation. If the answer is "NO", control returns to step S49 and the apparatus waits for reception of the next image data.

When the next image data is not received upon elapse of the predetermined period of time, control proceeds to step S51. Here the operation of the transport unit 206 is halted. Next, at step S52, the ink-jet heads 201–204 are moved to the recovery positions (201*a*–204*a*), after which control returns to step S41.

Thus, in accordance with the third embodiment, recovery of the ink-jet heads, movement of the ink-jet heads and activation of the transport unit are performed at the same time that image data is received. Moreover, when the next image data is not received within a predetermined period of time following the end of printing, the ink-jet heads are moved to the recovery process positions and the operation of the transport unit is halted. As a result, it is possible to shorten the time needed for ink-jet head recovery process immediately prior to start of the next job and for moving the ink-jet heads to the positions at which printing can be performed.

Thus, it is possible to greatly shorten the time from issuance of the printing start command by the customer to provision of the print to the customer.

[Fourth Embodiment]

Figure 14:
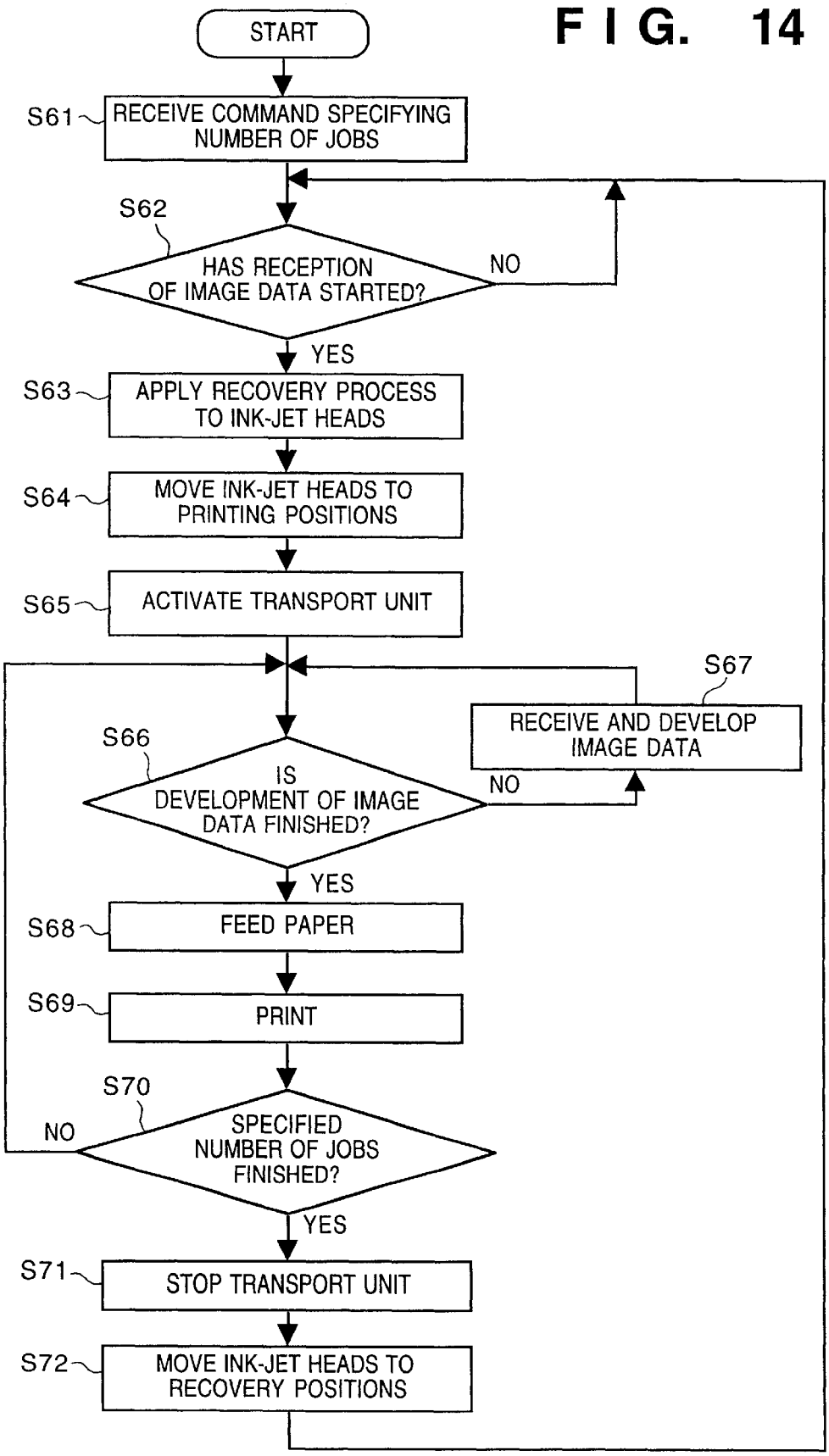
FIG. 14 is a flowchart illustrating printing processing in an ink-jet printing apparatus according to a fourth embodiment of the present invention.

FIG. 14 is a flowchart for describing the operation of the ink-jet printing apparatus 210 according to a fourth embodiment of the present invention.

According to the fourth embodiment, the host computer 602 initially transmits a command specifying number of jobs to the ink-jet printing apparatus 210 and then transfers the image data. As a result, the ink-jet printing apparatus 210 receives the job number command at step S61. When reception of the image data is found to have started at step S62, control proceeds to step S63. Here the reception of the image data is continued and, at the same time, the ink-jet heads 201–204 are subjected to the recovery process by the recovery mechanism 706. Control then proceeds to step S64, at which the ink-jet heads 201–204 are moved to the positions at which they can perform printing on the printing paper 205. In addition, the transport unit 206 is activated to transport the printing paper 205.

Under these conditions the received image data is developed in the image memories 704Y–704K at steps S66, S67. When the reception of the image data and the development of the images are completed at step S66, control proceeds to step S68. Here only one sheet of the printing paper is fed by the feeder unit 207. This is followed by step S69, at which the image data is printed on the printing paper 205 by ink droplets jetted from the ink-jet heads 201–204 in accordance with the image data that has been stored in the image memories 704Y–704K. One job is thus completed.

Next, it is determined at step S70 whether the number of jobs specified by the host computer 602 at step S61 has been attained. If the number has not been attained, control returns to step S66 and the above-described processing is executed. If the specified number of jobs have been completed, control proceeds to step S71, where the transport unit 206 is stopped, and thence to step S72, at which the ink-jet heads 201–204 are moved to the positions (201*a*–204*a*) at which the recovery operation is possible.

Thus, in a case where the number of jobs specified by the host computer 602 has not been reached when one job is finished, the apparatus waits for the reception of the next image data and for the development of the image data in the image memories 704Y–704K to end while the ink-jet heads 201–204 remain at the positions where printing is possible. When the development of image data corresponding to one sheet of printing paper 205 ends in the image memories 704Y–704K, the printing of the image data on this sheet of printing paper 205 is started immediately. This processing is repeatedly executed until the specified number of jobs is reached. When the specified number of jobs is reached, the transport unit 206 is stopped and the ink-jet heads 201–204 are moved to the positions at which recovery is possible. When the next job starts, therefore, the recovery process can be performed immediately.

If the development of image data in the image memories 704Y–704K is not finished even upon elapse of a predetermined period of time from the moment the ink-jet heads 201–204 are moved to the positions at which printing can be performed on the printing paper 205, the ink-jet heads 201–204 are moved to the recovery process positions in order to protect them, just as in the above-described embodiment.

Figure 15:
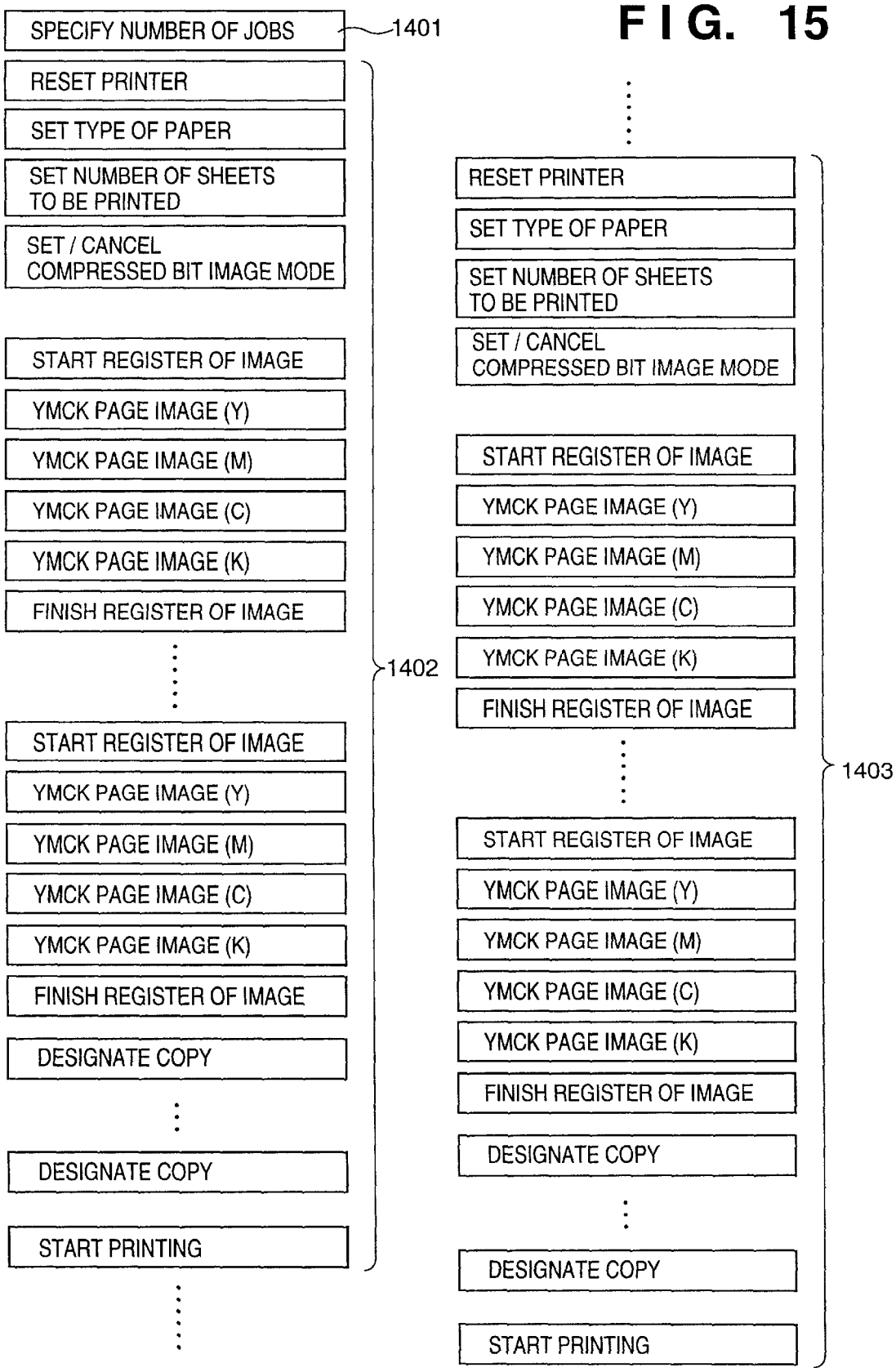
FIG. 15 is a diagram useful in describing a group of commands transmitted from a host computer to the ink-jet printing apparatus in this embodiment.

FIG. 15 is a diagram useful in describing a group of commands transmitted from the host computer 602 to the ink-jet printing apparatus 210 according to this embodiment of the invention.

First a command 1401 specifying the number of jobs is transferred from the host computer 602 to the ink-jet printing apparatus 210, after which image data from image data 1402 of the first job to image data 1403 of the last of the specified number of jobs is transmitted from the host computer 602 to the ink-jet printing apparatus 210.

Thus, as described above, recovery of the ink-jet heads 201–204, movement of the ink-jet heads 201–204 and activation of the transport unit are performed at the same time that image data is received. Moreover, the movement of the ink-jet heads and the halting of the transport unit are not carried out until the number of jobs specified is executed. As a result, the number of jobs transmitted from the host computer can be executed very efficiently.

As a result of this operation, the time from the start to the end of printing can be shortened. In the automatic vending machine described above, it is possible to greatly shorten the time from issuance of the printing start command by the customer to provision of the print to the customer.

FIG. 16 is a flowchart illustrating processing performed by an automatic printed-matter vending machine according to this embodiment. When a prescribed amount of money, for example, is introduced into the machine, two sheets on each of which a plurality of photographs have been printed are printed and output.

After introduction of the prescribed amount of money to the currency recognition unit 603 (FIG. 4) is sensed and the first photograph is taken by the image sensing device 607, the customer uses the touch-sensitive panel 604 to select the layout of the photographs on the first sheet. When the photographic video and layout have thus been decided, the image data is sent from the host computer 602 to the ink-jet printing apparatus 210 in the form of the commands shown in FIG. 15, by way of example. In response, the ink-jet printing apparatus 210 receives the command data at step S91 and, at step S92, analyzes the commands, develops them into bitmap data and stores the bitmap data in the image memories 704Y–704K according to the color-component data. This is followed by step S93, at which a color image is printed based upon the image data that has been developed in the image memories 704Y–704K. Timekeeping by the timer 700*a* starts after this print processing is finished. It is determined at step S95 whether data from the host computer 602 has been received. If "NO", the process then proceeds to step S96, where it is determined whether five seconds have elapsed based on the measurement by the timer 700*a*. When data is not received even upon elapse of five seconds, control proceeds to step S97. Here the ink-jet heads 201–204 are moved to the position of the recovery mechanism 706, the heads are capped and then control proceeds to step S99, and the timer 700*a* starts measuring time again in order to measure time up to the start of the next printing processing operation.

In concurrence with printing processing in the ink-jet printing apparatus 210, photography and selection of layout for the second sheet are carried out at the host computer 602, as indicated at step S82. When the photographic images and layout of the second sheet have been decided, the print data is sent to the ink-jet printing apparatus 210 by command of the kind shown in FIG. 15 just as at step S81. As a result, the ink-jet printing apparatus 210 senses data reception at step S95 or step S99 and proceeds to receive the data from the host computer 602 at step S100. In step S100, the command data from the host computer 602 is received and developed in step S101 just as at step S92. At the moment development of the data has ended and image data has been stored in the image memories 704Y–704K, it is determined at step S102 whether the time measured by the timer 700*a* has become equal to or exceeded 20 seconds. If the measured time is less than 20 seconds, control proceeds to step S104. If capping of the ink-jet heads has been carried out, capping is canceled and printing of the second sheet is carried out. If it is found at step S102 that the elapsed time is 20 seconds or greater, control proceeds to step S103. Here the cleaning of the ink-jet heads 201–204 is performed by the recovery mechanism 706. Then, when cleaning is finished, the printing of the second sheet is carried out at step S104.

Thus, customer waiting time can be shortened with this automatic printed-matter vending- machine and high-quality images can be printed.

The present invention has been described in regard to a printing apparatus based upon ink-jet printing technology using means (e.g., an electrothermal transducer or laser beam mechanism) for generating thermal energy as the energy utilized to discharge ink, wherein a change in the state of the ink is brought about by this thermal energy. High-density, high-definition printing can be achieved in accordance with this technology.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatuses. In the case of the on-demand type, at least one drive signal, which provides a sudden temperature rise that exceeds that for film boiling, is applied, in accordance with printing information, to an electrothermal transducer arranged to correspond to a sheet or fluid passageway holding a fluid (ink). As a result, thermal energy is produced in the electrothermal transducer to bring about film boiling on the thermal working surface of the ink-jet head. Accordingly, air bubbles can be formed in the fluid (ink) in one-to-one correspondence with the drive signals. Owing to growth and contraction of the air bubbles, the fluid (ink) is jetted via an orifice so as to form at least one droplet. If the drive signal has the form of a pulse, growth and contraction of the air bubbles can be made to take place rapidly and in appropriate fashion. This is preferred since it will be possible to achieve fluid (ink) discharge exhibiting excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention relating to the rate of increase in the temperature of the above-mentioned thermal working surface.

In addition to the combination of the orifice, fluid passageway and electrothermal transducer (in which the fluid passageway is linear or right-angled) disclosed as the construction of the print head in each of the above-mentioned specifications, an arrangement using the art described in the specifications of U.S. Pat. Nos. 4,558,333 and 4,459,600, which disclose elements disposed in an area in which the thermal working portion is curved, may be employed. Further, it is possible to adopt an arrangement based upon Japanese Patent Application Laid-Open No. 59-123670, which discloses a configuration having a common slot for the ink discharge portions of a plurality of electrothermal transducers, or Japanese Patent Application Laid-Open No. 59-138461, which discloses a configuration having openings made to correspond to the ink discharge portions, wherein the openings absorb the pressure waves of thermal energy.

As a print head of the full-line type having a length corresponding to the maximum width of the printing medium capable of being printed on by the printing apparatus, use can be made of an arrangement in which the length is satisfied by a combination of plural print heads of the kind disclosed in the foregoing specifications, or an arrangement in which print heads serve as a single integrally formed print head.

The print head may be of the replaceable chip-type, in which the connection to the apparatus and the supply of ink from the apparatus can be achieved by mounting the head on the apparatus, or of the cartridge type, in which the head itself is integrally provided with an ink tank.

In order to achieve the effects of the invention more stably, the printing apparatus of the present invention is additionally provided with printing head recovery means and auxiliary means. Specific examples are print head capping means, cleaning means, pressurizing or suction means, preheating means comprising an electrothermal transducer, a heating element separate from this transducer or a combination of the transducer and the heating element, and a pre-discharge mode for performing a discharge of ink separate from a discharge for printing. These expedients are effective in achieving stable printing.

Further, the foregoing embodiments of the invention described above have been described on the assumption that ink is a fluid. The ink used may be one which solidifies at room temperature or lower, one which softens at room temperature or one which is a liquid at room temperature. In general, temperature control is performed in such a manner that ink viscosity will fall within a stable ink jetting range by adjusting the temperature of the ink itself so as to fall within a temperature range of no less than 30° C. to no greater than 70° C. Accordingly, it will suffice to use an ink liquefied when the printing signal is applied.

In order to positively prevent elevated temperature due to thermal energy by using this as the energy for converting the ink from the solid state to the liquid state, or in order to prevent evaporation of the ink, it is permissible to use an ink which solidifies when left standing but which is liquefied by application of heat. In any case, ink which is liquefied for the first time by thermal energy, such as an ink liquefied by application of thermal energy conforming to a printing signal and jetted as a liquid ink, or ink which has already begun to solidify at the moment it reaches the printing medium, can be applied to the present invention. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the present invention can also be achieved by providing a storage medium storing the program codes of the software for performing the aforesaid functions of the foregoing embodiments to a system or an apparatus, reading the program codes with a computer (e.g., a CPU or MPU) of the system or apparatus from the storage medium, and then executing the program.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, the present invention covers a case where an operating system or the like working on the computer performs a part of or the entire process in accordance with the designation of program codes and implements the functions according to the embodiment.

The present invention further covers a case where, after the program codes read from the storage medium are written in a function extension board inserted into the computer or in a memory provided in EL function extension unit connected to the computer, a CPU or the like contained in the function extension board or function extension unit performs a part of or the entire process in accordance with the designation of program codes and implements the function of the above embodiments.

Though the various embodiments have been described independently, it goes without saying that the embodiments may be combined in suitable ways to constitute the present invention.

In accordance with the present invention, as described above, it is possible to prevent expenditure of ink by the ink-jet head recovery process and to perform printing reliably by not causing nozzles to fail in jetting ink in a case where different jobs are printed successively in an ink-jet printing apparatus. In addition, total printing time when these jobs are performed in succession can be shortened.

Further, the operation for recovery of the ink-jet heads, the movement of the ink-jet heads and the activation of the transport unit are performed at the same time that image data is received. Moreover, when the next image data is not received within a predetermined period of time following the end of printing, the ink-jet heads are moved to the recovery process positions and the operation of the transport unit is halted. As a result, it is possible to shorten the time needed for the next job to start.

Furthermore, a command specifying the number of jobs to be executed successively is received and, on the basis of the command, the processing for recovery of the print heads and the halting of the transport unit are not carried until the end of the specified number of jobs. As a result, total printing time in case of successive printing can be shortened.

Further, in a case where an ink-jet printing apparatus is employed as an automatic vending machine, it is possible to greatly shorten the time from issuance of a printing start command by the customer to provision of printed matter to the customer. The result is a marked increase in the ability to service customers.

The present invention is not limited to the above embodiments and various changes and modifications can be made within the spirit and scope of the present invention. Therefore, to apprise the public of the scope of the present invention, the following claims are made.

What is claimed is:

1. An ink-jet printing apparatus for performing different printing processings in successive fashion and printing an image on a printing medium by jetting ink onto the printing medium from an ink-jet print head, comprising:

recovery means for subjecting the ink-jet print head to a recovery process;

printing means for printing an image on the printing medium based upon image data received from a data source; and control means for suspending said recovery means from subjecting the ink-jet print head to the recovery process until a predetermined period of time has elapsed following a time at which the ink-jet print head has been capped after the printing of the image is completed.

2. The apparatus according to claim 1, wherein said control means causes said recovery means to perform the recovery process when a time from the end of printing of the image to an end of development of image data in a memory, for subsequent printing, becomes equal to or greater than the predetermined period of time.

3. The apparatus according to claim 1, further comprising transport means for transporting the printing medium, wherein the printing medium is transported by said transport means and the image is printed on the printing medium by said printing means, and said control means stops transport of the printing medium by said transport means if a predetermined period of time elapses following the end of printing of the image on the printing medium.

4. The apparatus according to claim 1, wherein said ink-jet print head comprises ink-jet heads for jetting inks of a plurality of colors.

5. The apparatus according to claim 4, wherein said ink-jet print head is a print head for jetting ink by utilizing thermal energy, said ink-jet print head having a thermal energy transducer for generating thermal energy applied to the ink.

6. An apparatus according to claim 1, wherein said control means comprises a timer for measuring the elapsed time after the ink-jet head has been capped.

7. An apparatus according to claim 1, wherein said control means causes said recovery means to subject the ink-jet print head to the recovery process immediately before the start of printing.

8. An ink-jet printing apparatus for performing different printing processings in successive fashion and printing an image on a printing medium by jetting ink onto the printing medium from an ink-jet print head, comprising:

recovery means for subjecting the ink-jet print head to a recovery process;

printing means for printing an image on the printing medium based upon image data received from a data source;

judging means for judging whether a number of sheets of the printing medium on which printing has been performed by said printing means has attained a predetermined number; and control means for suspending said recovery means from subjecting the ink-jet print head to the recovery process until said judging means has judged that the predetermined number has been attained.

9. The apparatus according to claim 8, wherein said recovery means subjects the ink-jet print head to the recovery process upon moving the ink-jet print head to a position different from that at which the ink-jet print head is capable of performing printing on the printing medium.

10. The apparatus according to claim 8, wherein the predetermined number of times is specified from the data source.

11. The apparatus according to claim 8, wherein the data source specifies the number of sheets of the printing medium for printing of image data the predetermined number also being specified by said data source.

12. The apparatus according to claim 8, further comprising transport means for transporting the printing medium, wherein the printing medium is transported by said transport means and the image is printed on the printing medium by said printing means, and said control means stops transport of the printing medium by said transport means if said judging means has judged that the predetermined number has been attained.

13. The apparatus according to claim 8, wherein said ink-jet print head comprises ink-jet heads for jetting inks of a plurality of colors.

14. The apparatus according to claim 13, wherein said ink-jet print head is a print head for jetting ink by utilizing thermal energy, said ink-jet print head having a thermal energy transducer for generating thermal energy applied to the ink.

15. An apparatus according to claim 8, wherein said control means causes said recovery means to subject the ink-jet print head to the recovery process immediately before the start of printing.

16. An ink-jet printing method for performing different printing processings in successive fashion and printing an image on a printing medium by jetting ink onto the printing medium from an ink-jet print head, comprising:

a printing step of printing an image on the printing medium based upon image data received from a data source; and a step of suspending the ink-jet print head from a recovery process until a predetermined period of time has elapsed following a time at which the ink-jet print head has been capped after the printing of the image is completed.

17. The method according to claim 16, wherein the recovery process applied to the ink-jet print head is performed when a time from the end of printing of the image to an end of development of image data in a memory, for subsequent printing, becomes equal to or greater than the predetermined period of time.

18. A method according to claim 16, wherein the predetermined period of time is measured by using a timer.

19. A method according to claim 16, wherein the recovery process is performed immediately before the start of printing.

20. An ink-jet printing method for performing different printing processings in successive fashion and printing an image on a printing medium by jetting ink onto the printing medium from an ink-jet print head, comprising:

a printing step of printing an image on the printing medium based upon image data received from a data source;

a judging step of judging whether a number of sheets of the printing medium on which printing has been performed in said printing step has attained a predetermined number; and a recovery process step of subjecting the ink-jet print head to a recovery process after having been judged in said judging step that the predetermined number has been attained.

21. The method according to claim 20, wherein the recovery process is performed upon moving the ink-jet print head to a position different from that at which the ink-jet print head is capable of performing printing on the printing medium.

22. The method according to claim 20, wherein the predetermined number of times is specified from the data source.

23. The method according to claim 20, wherein the data source specifies the number of sheets of the printing medium for printing of image data the, predetermined number also being specified by the data source.

24. The method according to claim 20, further comprising a transporting step of transporting the printing medium, wherein the printing medium is transported in said transporting step and the image is printed on the printing medium in said printing step, and transport of the printing medium in said transporting step is stopped if a predetermined period of time elapses following the end of printing of the image on the printing medium in said printing step.

25. The method according to claim 20, further comprising a transporting step of transporting the printing medium, wherein the printing medium is transported in said transporting step, the image is printed on the printing medium in said printing step, and transport of the printing medium is stopped after having been judged in said judging step that the predetermined number has been attained.

26. A method according to claim 20, wherein the recovery process is performed immediately before the start of printing.

27. A printing system including an ink-jet printing apparatus for performing different printing processings in successive fashion and printing an image on a printing medium by jetting ink onto the printing medium from an ink-jet print head, said ink-jet printing apparatus comprising:

recovery means for subjecting the ink-jet print head to a recovery process;

printing means for printing an image on the printing medium based upon image data received from a data source; and control means for suspending said recovery means from subjecting the ink-jet print head to the recovery process until a predetermined period of time has elapsed following a time at which the ink-jet print head has been capped after the printing of the image is completed; and said data source comprising:

input means for inputting data; and transmission means for determining image data to be transmitted to said ink-jet printing apparatus, based upon the data input by said input means, and transmitting the image data to said ink-jet printing apparatus.

28. The system according to claim 27, wherein said recovery means subjects the ink-jet print head to the recovery process upon moving the ink-jet print head to a position different from that at which the ink-jet print head is capable of performing printing on the printing medium.

29. The system according to claim 27, wherein said ink-jet print head comprises ink-jet heads for jetting inks of a plurality of colors.

30. The system according to claim 29, wherein said ink-jet print head is a print head for jetting ink by utilizing thermal energy, said ink-jet print head having a thermal energy transducer for generating thermal energy applied to the ink.

31. A system according to claim 27, wherein said control means comprises a timer for measuring the elapsed time after the ink-jet head has been capped.

32. A system according to claim 27, wherein said control means causes said recovery means to subject the ink-jet print head to the recovery process immediately before the start of printing.

33. A printing system including an ink-jet printing apparatus for performing different printing processings in successive fashion and printing an image on a printing medium by jetting ink onto the printing medium from an ink-jet print head, said ink-jet printing apparatus comprising:

recovery means for subjecting the ink-jet print head to a recovery process;

printing means for printing an image on the printing medium based upon image data received from a data source;

judging means for judging whether a number of sheets of the printing medium on which printing has been performed by said printing means has attained a predetermined number; and control means for suspending said recovery means from subjecting the ink-jet print head to the recovery process until said judging means has judged that the predetermined number has been attained; and said data source comprising:

input means for inputting data;

transmission means for determining image data to be transmitted to said ink-jet printing apparatus, based upon the data input by said input means, and transmitting the image data to said ink-jet printing apparatus; and notification means for notifying said ink-jet printing apparatus of a number of printing operations for performing the recovery process.

34. The system according to claim 33, wherein said data source comprises means for notifying said ink-jet printing apparatus of a total number of sheets of the printing medium for printing the image data.

35. A system according to claim 33, wherein said control means causes said recovery means to subject the ink-jet print head to the recovery process immediately before the start of printing.

* * * * *

UNITED STATES PATENT AND TRADEMARK OFFICE

CERTIFICATE OF CORRECTION

PATENT NO. : 6,338,540 B1
DATED : January 15, 2002
INVENTOR(S) : Hasegawa et al.

It is certified that error appears in the above-identified patent and that said Letters Patent is hereby corrected as shown below:

Column 14,
Line 22, "EL" should read -- a --.

Column 16,
Line 3, "data" should read -- data, --.

Column 17,
Line 6, "data the," should read -- data, the --.

Signed and Sealed this

Eighteenth Day of June, 2002

*Attest:*

*Attesting Officer*

JAMES E. ROGAN
*Director of the United States Patent and Trademark Office*